US005611221A

United States Patent [19]

Tremel

[11] Patent Number: 5,611,221

[45] Date of Patent: Mar. 18, 1997

[54] DOUBLE ACTION AGITATOR ASSEMBLY

[75] Inventor: Curtis J. Tremel, Newton, Iowa

[73] Assignee: Maytag Corporation, Newton, Iowa

[21] Appl. No.: 563,670

[22] Filed: Nov. 28, 1995

[51] Int. Cl.[6] ..... D06F 17/08

[52] U.S. Cl. ..... 68/133; 192/46; 384/276

[58] Field of Search ..... 68/133, 134; 192/46; 384/276

[56] References Cited

U.S. PATENT DOCUMENTS

| | | | |
|---|---|---|---|
| 3,987,508 | 10/1976 | Platt | 8/159 |
| 3,987,651 | 10/1976 | Platt | 68/133 |
| 3,987,652 | 10/1976 | Ruble | 68/134 |
| 4,068,503 | 1/1978 | Platt | 68/133 |
| 4,155,228 | 5/1979 | Burgener, Jr. et al. | 68/133 |
| 4,164,130 | 8/1979 | Hammer | 68/133 |
| 4,718,258 | 1/1988 | Mason et al. | 68/133 |
| 4,719,769 | 1/1988 | Pielemeier et al. | 68/133 |
| 4,856,303 | 8/1989 | Hood, Jr. et al. | 68/133 |
| 4,920,770 | 5/1990 | Dooley et al. | 68/133 |

*Primary Examiner*—Philip R. Coe
*Attorney, Agent, or Firm*—Zarley, McKee, Thomte, Voorhees & Sease

[57] ABSTRACT

An agitator assembly for a fabric washer includes an agitator body having an elongated agitator barrel and a plurality of vanes extending radially outwardly from one end of the agitator barrel. An auger tube is telescopically mounted over the agitator barrel and includes a helical flighting on its outer surface. A bearing assembly is located between the outer surface of the agitator barrel and the inner surface of the auger tube, and holds the inner auger tube surface free from contact with the outer agitator barrel while at the same time permitting relative rotational movement between the auger tube and the agitator body. A ratchet clutch assembly is provided for permitting the auger tube to rotate only in one direction with respect to the agitator. The ratchet clutch assembly includes a circular array of ratchet teeth, and a plurality of ball bearings resting upon the ratchet teeth. The ball bearings move vertically in vertical tracks.

16 Claims, 5 Drawing Sheets

DOUBLE ACTION AGITATOR ASSEMBLY

BACKGROUND OF THE INVENTION

This invention relates to a double action agitator assembly.

Prior art fabric washers have sometimes included a double action agitator having an agitator body which oscillates back and forth rotationally and having an auger body rotatably mounted thereon for rotation in a single direction with step wise or ratcheted movements. The oscillating agitator body includes a lower skirt and an upper barrel or tube. The skirt carries vanes which agitate the fabrics being washed. The auger body is mounted on the agitator barrel and includes helical vanes which create a downward flow adjacent the agitator barrel so as to cause positive roll over of the clothes or fabrics being washed.

One problem encountered with prior art double action agitators is the need for an adequate bearing assembly to mount the auger body for rotation on the barrel of the agitator body. Prior art bearing assemblies for rotatably mounting the two together often permit a loose feel therebetween which can result in the auger wobbling as it operates.

Therefore a primary object of the present invention is the provision of an improved double action agitator assembly.

A further object of the present invention is the provision of an improved double action agitator assembly which includes an improved bearing assembly between the auger body of the agitator and the barrel of the agitator body.

A further object of the present invention is the provision of an improved bearing assembly which minimizes wobbling or looseness between the auger body and the barrel of the agitator body.

A further object of the present invention is the provision of an improved ratchet clutch mechanism for permitting the agitator body to rotate in an oscillating motion while at the same time permitting the auger body to rotate unidirectionally.

A further object of the present invention is the provision of an improved double action agitator assembly which is comprised entirely of plastic and which does not include metal parts.

A further object of the present invention is the provision of an improved double action agitator assembly which is economical to manufacture, durable in use, and efficient in operation.

SUMMARY OF THE INVENTION

The foregoing objects may be achieved by an agitator assembly having an agitator body and an auger body. The agitator body includes an elongated agitator barrel having first and second opposite barrel ends and an outer barrel surface. The agitator body further includes a plurality of vanes circumferentially spaced apart from one another and extending radially outwardly from the agitator barrel adjacent one end thereof.

The auger body includes an inner auger tube surface forming an elongated auger tube bore extending through the auger body and having an outer auger tube surface containing a helical auger flighting thereon.

The auger body is telescopically fitted over the agitator barrel. A bearing assembly is provided between the outer agitator barrel surface and the inner auger tube surface for holding the inner auger tube surface free from contact with the outer agitator barrel surface while at the same time permitting relative rotational movement between the auger tube and the agitator body about an agitator axis.

Another feature of the present invention is the use of a bearing assembly having a first bearing surface and a second bearing surface which are spaced axially apart from one another along the agitator axis. These spaced apart first and second bearing surfaces minimize wobbling action between the auger tube and the agitator barrel.

Another feature of the present invention is the provision of first and second annular flanges on the interior auger tube surface and third and fourth cooperable spaced apart flanges on the outer agitator barrel surface. The first and second flanges and the third and fourth flanges being diagonally opposed and cooperative for engaging opposite ends of the bearing assembly to limit axial movement of the auger tube in either axial direction.

Another feature of the present invention is the provision of an outer auger tube surface which has a conical shape reducing in cross section adjacent the vanes of the agitator body and increasing in cross section adjacent the end of the agitator barrel which is telescopically received within the auger tube bore.

Another feature of the present invention is the provision of a unique clutch mechanism between the agitator body and the auger body. The clutch mechanism permits the auger body to rotate in only one direction relative to the agitator barrel. The clutch mechanism includes a plurality of axially extending tracks on either the agitator barrel or the inner auger tube surface, and a plurality of ratchet teeth on the other of the agitator barrel and the inner auger tube surface. The clutch mechanism also includes a plurality of balls each of which is contained within one of the tracks and is in engagement with one of the ratchet teeth.

DETAILED DESCRIPTION OF THE PREFERRED EMBODIMENT

Figure 1:
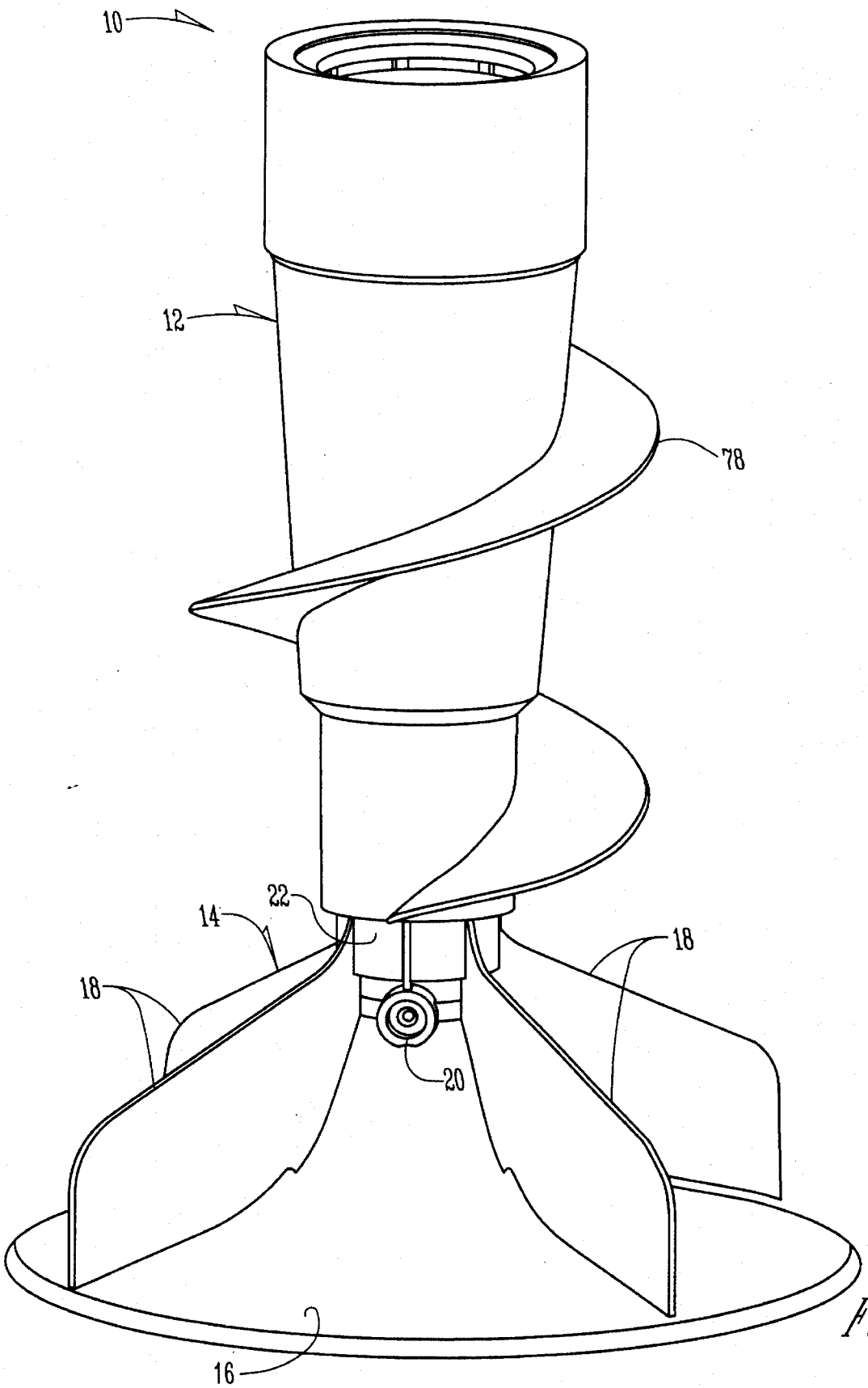
FIG. 1 is a perspective view of the double action agitator assembly of the present invention.

Referring to the drawings, the numeral 10 generally designates the double action agitator assembly of the present invention. Assembly 10 includes an auger body 12 and an agitator body 14. Agitator body 14 includes a skirt 16 at its lower end. A plurality of fins 18 extend radially outwardly to the outer edge of the skirt 16. A set screw receptacle 20 is adapted to receive a set screw for attaching the agitator to a splined drive shaft (not shown) which causes the agitator body 14 to rotate in an oscillating motion. Extending upwardly from the fins 18 is a cylindrical agitator barrel 22 having an outer barrel surface 24 (FIG. 3) and an inner barrel surface 26 which surrounds an elongated agitator barrel bore 28. At the lower end of the barrel bore 28 are a plurality of fluid communication openings 30 which permit washing fluid to communicate freely between the interior and the exterior of the barrel bore 28. Protruding outwardly from the outer barrel surface 24 is an annular stop flange 32 which has an upwardly presented beveled surface. At the upper end of barrel 22 are four latching fingers 34 each of which have a latching pawl 36 thereon.

Figure 2:
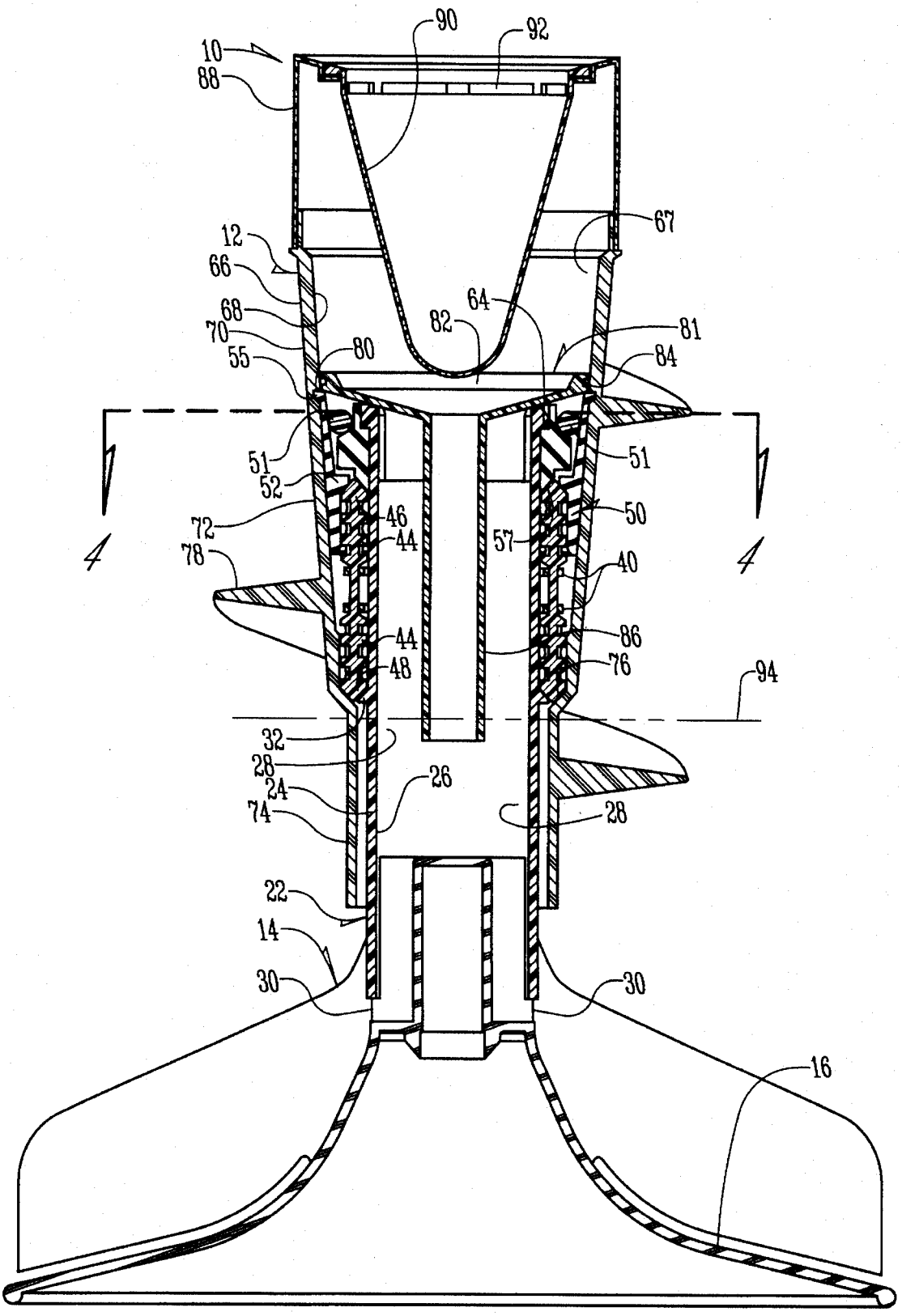
FIG. 2 is a vertical sectional view of the double action agitator assembly shown in FIG. 1.

A bearing assembly 38 is adapted to be positioned between the auger body 12 and the barrel 22 for providing rotational movement therebetween (FIG. 2). Bearing assembly 38 (FIG. 3) includes a pair of spaced apart bearing rings 40 which rotatably support three bearings 42. Each bearing 42 is elongated and includes a plurality of annular bearing surfaces 44 thereon. While the number of bearing surfaces 44 may vary without detracting from the invention, it is preferred that at least two bearing surfaces 44 be provided, and that they be spaced apart adjacent the upper and lower ends of the bearings 42. At the extreme upper end of each bearing 42 is an upper tapered bearing surface 46, and at the extreme lower end of each bearing 42 is a lower tapered bearing surface 48.

A track ring 50 includes an interior annular flange 52 and a plurality of latching fingers 53 spaced approximately 120° apart and which are adapted to spring radially inwardly and outwardly. The spaces between the fingers 53 form vertical tracks 54 for receiving ball bearings 51. At the upper outer tips of the fingers 53 are latching pawls 55.

A ratchet gear 56 includes a plurality of ratchet teeth 58 which extend circumferentially around a cylindrically shaped collar 59. Each ratchet tooth 58 includes a ramp surface 60 and a vertical stop surface 62. Extending around the interior diameter of ratchet collar 59 is an upwardly facing annular shoulder 64.

Auger body 12 is comprised of an auger tube 66 which forms an auger tube bore 67 surrounded by an inner auger tube surface 68. Auger tube 66 also includes an outer auger tube surface 70 which is formed into a conical portion 72 and a cylindrical portion 74. The conical portion 72 of the outer auger tube 70 provides additional space adjacent the agitator 10 for allowing clothing to move in a generally circular rollover pattern. At the juncture between the conical portion 72 and the cylindrical portion 74 is a tapered flange 76 (FIG. 2). Extending around the outer surface 70 of the auger tube 66 is a helical flighting 78. On the inner auger tube surface 68 is an annular slot 80.

A funnel 81 includes a circular funnel top 82 having an annular O-ring 84 extending around its rim. Extending downwardly from the funnel top 82 is a drain tube 86.

Press fitted over the top of auger tube 66 is a softener housing 88 having a softener container 90 therein which is provided around its upper rim with a plurality of spill openings 92.

Figure 3:
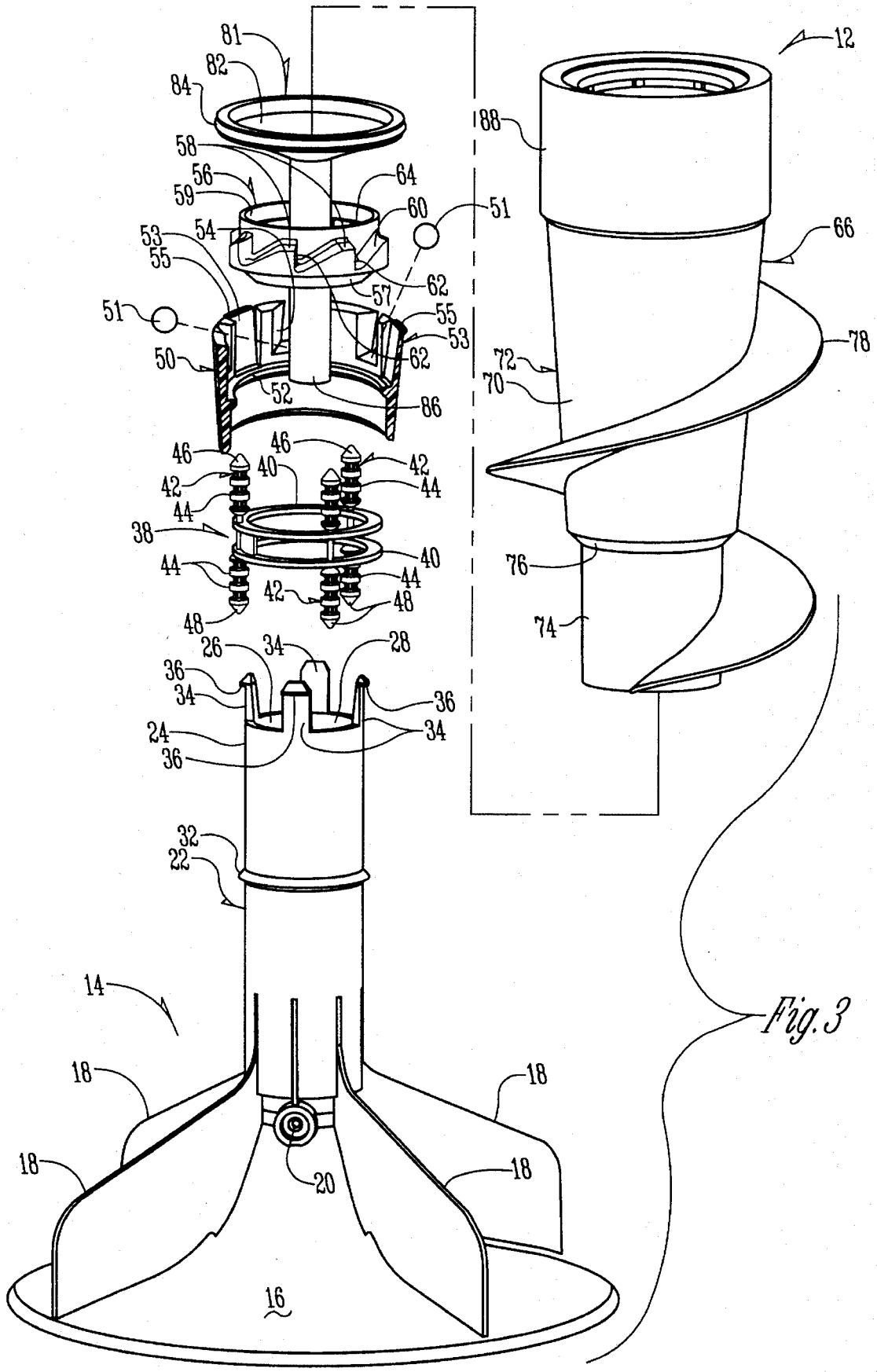
FIG. 3 is an exploded perspective view of the double action agitator assembly of FIG. 1.

The assembly of the various parts of the agitator assembly 10 are shown in FIGS. 2 and 3. Initially the auger body 12 is slipped over the agitator barrel 22 as shown in FIG. 2. Next, the bearing assembly 38 is slipped over the outer barrel surface 24 of agitator body 22 and positioned so that the lower tapered bearing surfaces 48 bear against tapered surface of the annular stop flange 32 and against the tapered flange 76. In this position the annular bearing surfaces 44 of bearing assembly 38 rotate on the outer barrel surface 24 of the agitator body 14.

The track ring 50 is then inserted into the interior of auger tube 66. The outer surface of track ring 50 is conically shaped so as to conform to the conical inner auger tube surface 68. Insertion of the track ring 50 to the position shown in FIG. 2 causes the pawls 55 of latching fingers 53 to spring into the slot 80 which extends circumferentially around the inner surface 68 of auger tube 66 as shown in FIG. 2. This causes the track ring 50 to be locked into retentive engagement with the interior surface 68 of the auger tube 66.

With the auger assembly in the position shown in FIG. 2, the interior flange 52 of track ring 50 engages the upper tapered bearing surface 46 at the top of bearing assembly 38 as can be seen in FIG. 2.

Next, the ratchet gear 56 is inserted into the auger tube bore 67 and is slipped over the latching fingers 34 at the top of agitator barrel 22 until the latching pawls 36 snap outwardly in retentive engagement over the annular shoulder 64 on the interior of the ratchet collar 59. This engagement of the pawls 36 with the shoulder 64 causes the ratchet gear 56 to be attached to the upper end of the agitator barrel 22 in the position shown in FIG. 2. In this posture, the annular flange 57 of the ratchet gear 56 cooperates with the interior flange 52 of track ring 50 for engagement of the upper tapered bearing surface 46. Six ball bearings 51 are placed between the track ring 50 and the ratchet gear 56 and are aligned in the six vertical tracks 54.

In this position, the auger body 12 is free to rotate about the outer surface 24 of the agitator barrel 22. The bearing assembly 38 separates the auger body 12 from the agitator body 14 so that there is no direct contact therebetween. The separation of the upper most bearing surfaces 44 from the lower most bearing surfaces 44 in bearing assembly 38 provides a positive rotational attachment of the auger body 12 with respect to the agitator barrel 22 and prevents any play or wobbling therebetween during rotation of the auger body 12 about the agitator barrel 22. Axial movement of the auger body 12 with respect to the agitator barrel 22 is limited by the engagement of the upper and lower tapered bearing surfaces 46, 48 with diagonally opposed flange pairs 32, 52 and 57, 76 associated with the interior auger tube surface 68 and the outer barrel surface 24.

The funnel 81 is then inserted into the auger tube bore 67 with the O-ring 84 providing a seal against the interior surface 68 of the auger tube bore 67. This provides an airtight seal within the auger tube bore 67 below the funnel top 82.

Figure 4:
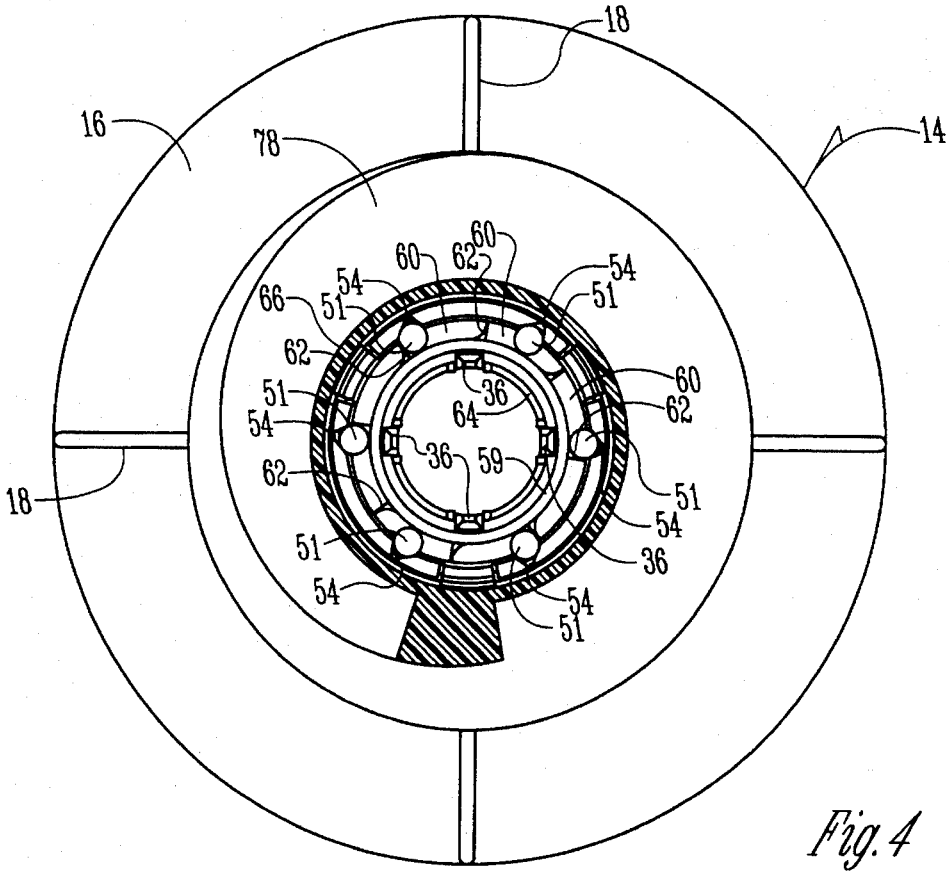
FIG. 4 is a sectional view taken along line 4—4 of FIG. 2.

The combination of the ratchet gear 56, the track ring 50, and the six ball bearings 51 provides a ratchet clutch mechanism for causing the auger body 12 to rotate only in one direction relative to the agitator body 14. This ratchet clutch mechanism is illustrated in FIGS. 4 through 7. In FIG. 4 there are shown six ball bearings 51, each of which is positioned within one of the vertical tracks 54 of the track ring 50. Each of the ball bearings 51 rest upon the ramp surfaces 60 of the ratchet teeth 58. Two of the six ball bearings rest against the stop surface 62 of two of the ratchet teeth 58. Two additional ones of the ball bearings 51 are positioned midway between the two spaced apart stop surfaces 62, and the remaining two ball bearings 51 are positioned at the very upper edge of the ramp surfaces 60, closely adjacent and above the stop surface 62. These relative positions are illustrated best in FIG. 7 which schematically shows a linear representation of the circular array of ratchet teeth 58.

Figure 5:
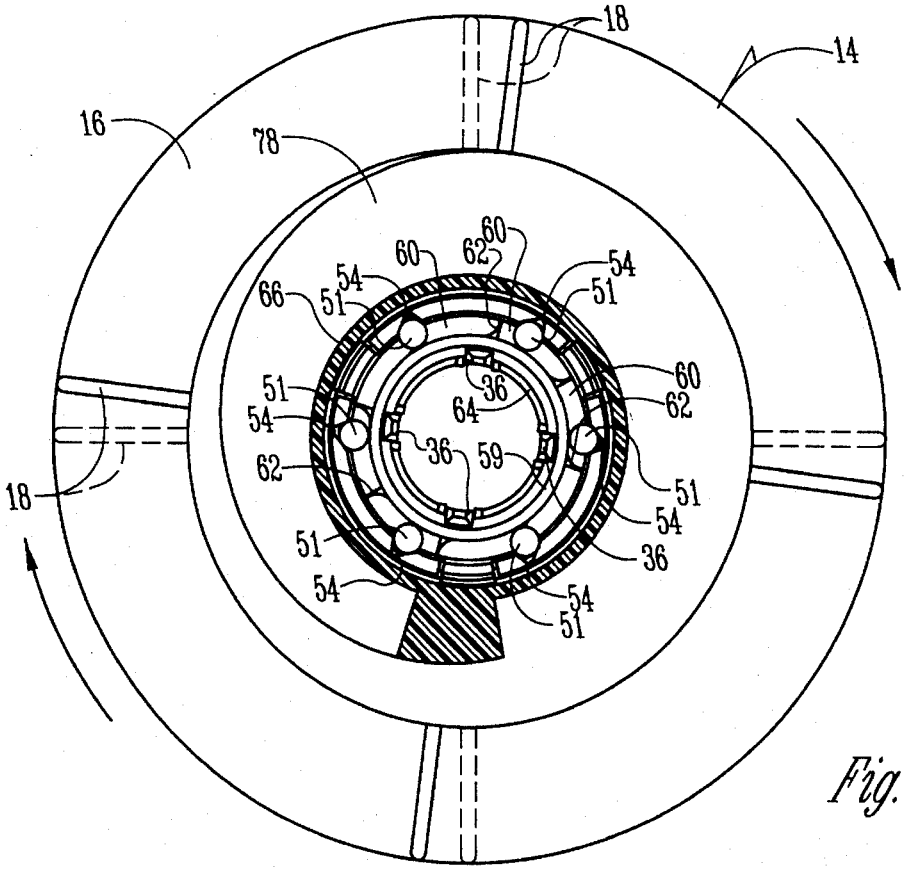
FIG. 5 is a view similar to FIG. 4, but showing rotation of the agitator body in a clockwise direction from what is shown in FIG. 4.

The agitator body 14 is adapted to be driven by a motor (not shown) in oscillating fashion, first rotating in a clockwise direction and then rotating in a counterclockwise direction. FIG. 5 illustrates the first step of the cycle wherein the agitator body 14 rotates in a clockwise direction. This rotational movement is for a circumferential distance of approximately 97°. During this movement, the inertia of the auger body 12 and the drag of the wash water and clothing being washed causes it to remain stationary, and the ball bearings 51 are free to roll up the inclined surfaces 60. Two of the ball bearings 51 fall downwardly when they reach the extreme upper end of ramp 60.

Figure 6:
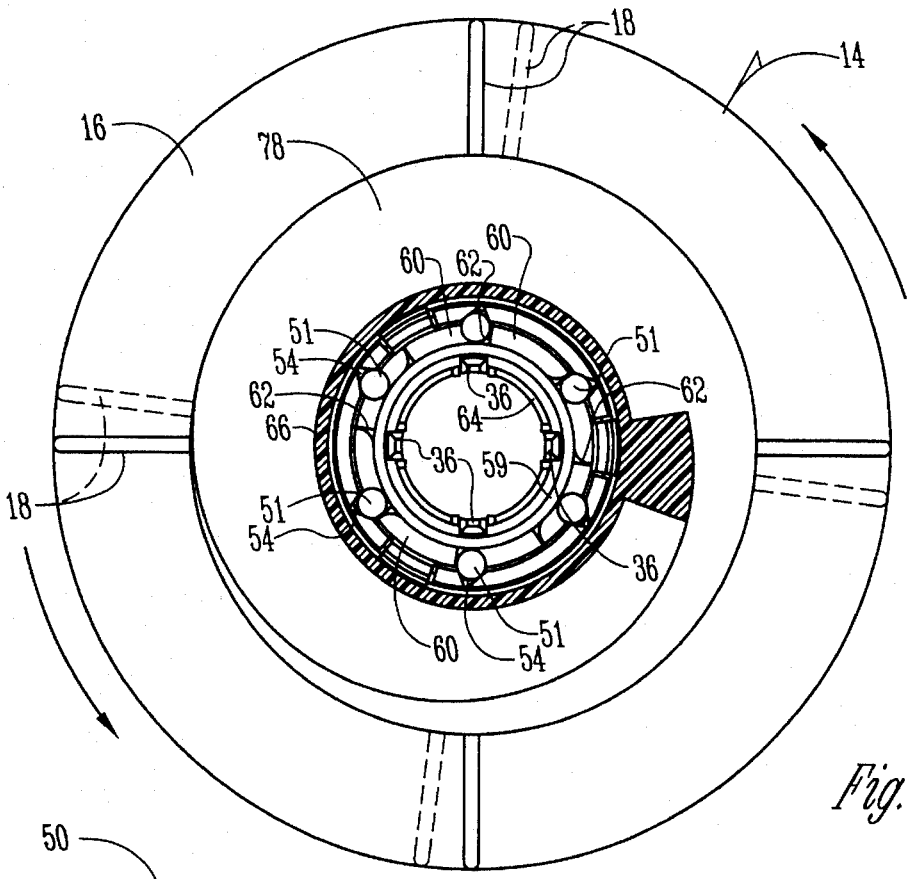
FIG. 6 is a view similar to FIG. 5, but showing the rotation of the agitator body in a counterclockwise direction relative to the auger body from what is shown in FIG. 5.
Figure 7:
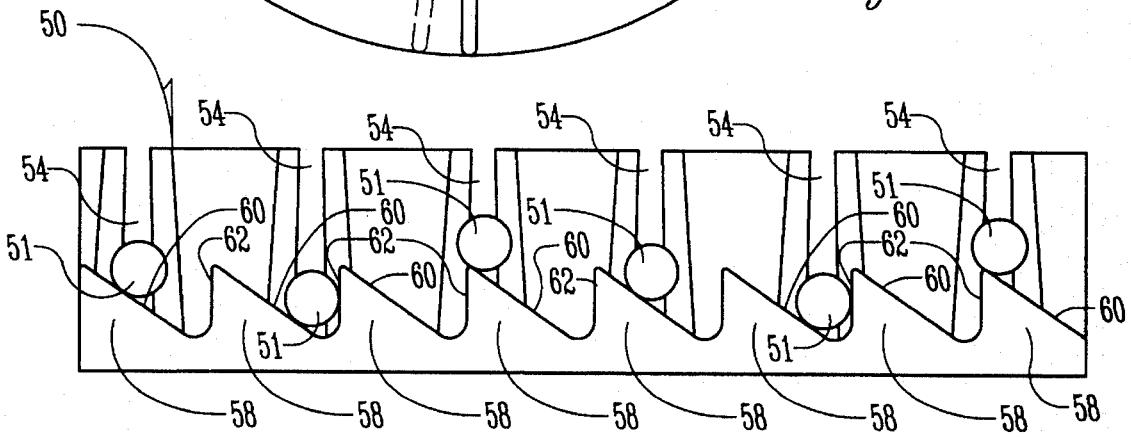
FIG. 7 is a schematic view showing the relative positions of the vertical tracks, the ratchet teeth, and the balls in the ratchet clutch mechanism.
Figure 8:
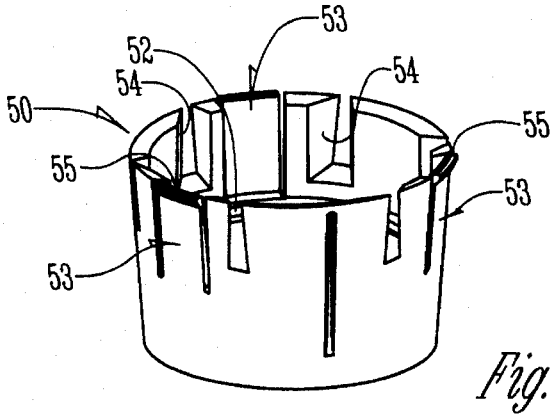
FIG. 8 is a pictorial view of the track ring of the present invention.

FIG. 6 shows the rotation of the agitator body in an opposite or counterclockwise direction 97°. Because two of the ball bearings 51 engage the stop surfaces 62 of two of the teeth 58, the auger assembly 12 is forced to rotate in a counterclockwise direction in unison with the agitator body 14.

As the agitator body 14 again reverses and rotates in a clockwise direction, the ball bearings 51 advance upwardly on the inclined surfaces 60, and two new ball bearings 51 fall downwardly into engagement with the stop surfaces 62. Thus there are always two ball bearings 51 engaging the stop surfaces 62, two ball bearings 51 midway up the ramp surface 60, and two ball bearings 51 at the very upper extreme end of the ramp surface 60. While the ratchet assembly of the present invention is shown with eight ratchet teeth 58 and six ball bearings 51, other combinations of ball bearings 51 and ratchet teeth 58 may be used without detracting from the invention.

Because the funnel 81 provides an airtight seal within the interior of auger tube bore 67, the water which surrounds the agitator assembly 10 cannot rise to a level within the auger tube bore 67 to permit it to come in contact with the bearing assembly 38. Line 94 in FIG. 2 shows the approximate level of water within the agitator barrel 22, even when the water level surrounding the agitator assembly 10 extends upwardly to the top of the auger flighting 78.

During the spin cycle of the washing machine, water softener within the container 90 spills upwardly by centrifugal force through the spill openings 92 and falls through the drain tube 86 down to the water which is within the interior of barrel 22. Ultimately this softener exits through the fluid communication openings 30 into the tub of the machine containing the fabrics for washing.

The present invention provides many advantages. The entire agitator assembly 10 can be constructed of plastic and can be molded so as to eliminate the need for metal parts. The bearing assembly 38 provides a solid positive rotational mounting of the auger body 12 with respect to the agitator body 14, and eliminates wobbling or play between the auger body 12 and the agitator body 14 during rotation. The ratchet assembly provided by the ball bearings 51, the ratchet teeth 58, the vertical tracks 54, and the collar 59 of the ratchet gear 56 permit the auger body 12 to rotate in only one direction with respect to the rotation of the agitator body 14. This causes the flightings 78 to force fabrics and clothing downwardly during the washing cycle thereby providing positive turnover of the fabrics being washed.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. An agitator assembly for a fabric washer comprising:

an agitator body comprising an elongated agitator barrel having first and second opposite agitator barrel ends and an outer agitator barrel surface, said agitator body further comprising a plurality of vanes circumferentially spaced apart from one another and extending radially outwardly from said outer agitator barrel surface adjacent said first agitator barrel end;

an auger tube having an inner auger tube surface forming an elongated auger tube bore extending through said auger tube and having an outer auger tube surface containing a helical auger flighting thereon;

said second end of said agitator barrel being telescopically received within said auger tube bore;

a bearing assembly between said outer agitator barrel surface and said inner auger tube surface and holding said inner auger tube surface free from contact with said outer agitator barrel surface while at the same time permitting relative rotational movement between said auger tube and said agitator body about an agitator axis.

2. An agitator assembly according to claim 1 wherein said bearing assembly further comprises a plurality of rotatable first bearing surfaces and a plurality of rotatable second bearing surfaces spaced axially apart from said first bearing surfaces along said agitator axis.

3. An agitator assembly according to claim 2 wherein said bearing assembly comprises a plurality of elongated rotatable bearing members each having first and second ends, each of said bearing members containing one of said first bearing surfaces and one of said second bearing surfaces.

4. An agitator assembly according to claim 3 wherein said bearing assembly further comprises at least one bearing ring, said plurality of bearing members each being rotatably mounted to said bearing ring.

5. An agitator assembly according to claim 1 and further comprising first and second cooperable spaced apart annular flanges on said inner auger tube surface and said outer agitator barrel surface; third and fourth cooperable spaced apart annular flanges on said inner auger tube surface and said outer agitator barrel surface, said first and second flanges and said third and fourth flanges being diagonally opposed and cooperable for engaging opposite ends of said bearing assembly to limit axial movement of said auger tube relative to said agitator barrel.

6. An agitator assembly according to claim 1 wherein said outer auger tube surface has a conical shape with a reduced cross-section adjacent said vanes of said agitator body and which has an increased cross-section adjacent said second end of said agitator barrel when said second end of said agitator barrel is telescopically received in said auger tube bore.

7. An agitator assembly according to claim 1 wherein said agitator body, said auger tube, and said bearing assembly are all made of plastic.

8. An agitator assembly according to claim 1 and further including a clutch mechanism between said outer agitator barrel surface of said agitator body and said auger tube bore of said auger tube, said clutch mechanism permitting relative rotational movement in only one direction between said agitator body and said auger tube; said clutch mechanism comprising a plurality of axially extending tracks on one of said outer agitator barrel surface and said inner auger tube surface, a plurality of ratchet teeth on the other of said outer agitator barrel surface and said inner auger tube surface, and a plurality of balls, each of which is contained within one of said tracks and is in engagement with one of said ratchet teeth.

9. An agitator assembly for a fabric washer comprising:

an agitator body comprising an elongated agitator barrel having first and second opposite agitator barrel ends and an outer agitator barrel surface, said agitator body further comprising a plurality of vanes circumferentially spaced apart from one another and extending radially outwardly from said outer agitator barrel surface adjacent said first agitator barrel end;

an auger tube having an inner auger tube surface forming an elongated auger tube bore extending through said auger tube and having an outer auger tube surface containing a helical auger flighting thereon;

said second end of said agitator barrel being telescopically received within said auger tube bore;

a bearing assembly between said outer agitator barrel surface and said inner auger tube surface and permitting relative rotational movement between said auger tube and said agitator body;

said bearing assembly comprising a plurality of rotatable first bearing surfaces and a plurality of rotatable second bearing surfaces spaced axially apart from said first bearing surfaces along said agitator axis.

10. An agitator assembly for a fabric washer comprising:

an agitator body comprising an elongated agitator barrel having first and second opposite agitator barrel ends and an outer agitator barrel surface, said agitator body further comprising a plurality of vanes circumferentially spaced apart from one another and extending radially outwardly from said outer agitator barrel surface adjacent said first agitator barrel end;

an auger tube having an inner auger tube surface forming an elongated auger tube bore extending through said auger tube and having an outer auger tube surface containing a helical auger flighting thereon;

said second end of said agitator barrel being telescopically received within said auger tube bore;

a bearing assembly between said outer agitator barrel surface and said inner auger tube surface and permitting relative rotational movement between said auger tube and said agitator body;

first and second cooperable spaced apart annular flanges on said inner auger tube surface and said outer agitator barrel surface;

third and fourth cooperable spaced apart annular flanges on said inner auger tube surface and said outer agitator barrel surface, said first and second flanges and said third and fourth flanges being diagonally opposed and cooperable for engaging opposite ends of said bearing assembly to limit axial movement of said auger tube relative to said agitator barrel.

11. An agitator assembly for a fabric washer comprising:

an agitator body comprising an elongated agitator barrel having first and second opposite agitator barrel ends and an outer agitator barrel surface, said agitator body further comprising a plurality of vanes circumferentially spaced apart from one another and extending radially outwardly from said outer agitator barrel surface adjacent said first agitator barrel end;

an auger tube having an inner auger tube surface forming an elongated auger tube bore extending through said auger tube and having an outer auger tube surface containing a helical auger flighting thereon;

said second end of said agitator barrel being telescopically received within said auger tube bore;

a bearing assembly between said outer agitator barrel surface and said inner auger tube surface and permitting relative rotational movement between said auger tube and said agitator body;

said outer auger tube surface having a conical shape which has a reduced cross section adjacent said vanes of said agitator body and which has an increased cross section adjacent said second end of said agitator barrel.

12. An agitator assembly for a fabric washer comprising:

an agitator body comprising an elongated agitator barrel having first and second opposite agitator barrel ends and an outer agitator barrel surface, said agitator body further comprising a plurality of vanes circumferentially spaced apart from one another and extending radially outwardly from said outer agitator barrel surface adjacent said first agitator barrel end;

an auger tube having an inner auger tube surface forming an elongated auger tube bore extending through said auger tube and having an outer auger tube surface containing a helical auger flighting thereon;

said second end of said agitator barrel being telescopically received within said auger tube bore;

a bearing assembly between said outer agitator barrel surface and said inner auger tube surface and permitting relative rotational movement between said auger tube and said agitator body;

a clutch mechanism between said outer agitator barrel surface of said agitator body and said inner tube bore of said auger tube, said clutch mechanism permitting relative rotational movement in only one direction between said agitator body and said auger tube;

said clutch mechanism comprising a plurality of axially extending tracks on one of said outer agitator barrel surface and said inner auger tube surface, a plurality of ratchet teeth on the other of said outer agitator barrel surface and said inner auger tube surface, and a plurality of balls, each of which is contained within one of said tracks and is in engagement with one of said ratchet teeth.

13. An agitator assembly according to claim 12 wherein each of said ratchet teeth have an inclined ramp surface and a stop surface, at least one of said balls engaging said stop surface and one of said tracks to prevent relative rotation in said one direction between said agitator body and said auger tube.

14. An agitator assembly according to claim 12 wherein said outer auger tube surface has a conical shape with a reduced cross-section adjacent said vanes of said agitator body and which has an increased cross-section adjacent said second end of said agitator barrel when said second end of said agitator barrel is telescopically received in said auger tube bore.

15. An agitator assembly according to claim 12 and further comprising first and second cooperable spaced apart annular flanges on said inner auger tube surface and said outer agitator barrel surface; third and fourth cooperable spaced apart annular flanges on said inner auger tube surface and said outer agitator barrel surface, said first and second flanges and said third and fourth flanges being diagonally opposed and cooperable for engaging opposite ends of said bearing assembly to limit axial movement of said auger tube relative to said agitator barrel.

16. An agitator assembly according to claim 12 wherein said bearing assembly comprising a plurality of rotatable first bearing surfaces and a plurality of rotatable second bearing surfaces spaced axially apart from said first bearing surfaces along said agitator axis.

* * * * *